US008543049B2

(12) United States Patent
Kobayashi et al.

(10) Patent No.: US 8,543,049 B2
(45) Date of Patent: Sep. 24, 2013

(54) CLEANING APPARATUS AND IMAGE FORMING APPARATUS

(75) Inventors: Kiyotaka Kobayashi, Osaka (JP); Takahiko Murata, Osaka (JP); Ai Takagami, Osaka (JP); Yoshimi Shimizu, Kyoto (JP); Mitsuhiro Goda, Osaka (JP); Susumu Hanano, Osaka (JP); Hirofumi Tsuji, Nara (JP); Chisato Hatakeyama, Kawasaki (JP); Katsuya Ota, Osaka (JP)

(73) Assignee: Kyocera Document Solutions Inc. (JP)

( * ) Notice: Subject to any disclaimer, the term of this patent is extended or adjusted under 35 U.S.C. 154(b) by 335 days.

(21) Appl. No.: 12/964,039

(22) Filed: Dec. 9, 2010

(65) Prior Publication Data

US 2011/0158722 A1 Jun. 30, 2011

(30) Foreign Application Priority Data

Dec. 25, 2009 (JP) ..... P2009-295799
Dec. 25, 2009 (JP) ..... P2009-295800

(51) Int. Cl.
*G03G 21/00* (2006.01)

(52) U.S. Cl.
USPC ..... 399/357; 399/343; 399/71

(58) Field of Classification Search
USPC ..... 399/357, 343, 71
See application file for complete search history.

(56) References Cited

U.S. PATENT DOCUMENTS

| | | | | |
|---|---|---|---|---|
| 7,668,477 | B2 * | 2/2010 | Honobe et al. | 399/100 |
| 2005/0089788 | A1 * | 4/2005 | Nukada et al. | 430/125 |
| 2007/0292178 | A1 * | 12/2007 | Iwasaki et al. | 399/357 |

FOREIGN PATENT DOCUMENTS

| | | |
|---|---|---|
| JP | A-07-036342 | 2/1995 |
| JP | 2004-341257 | 12/2004 |
| JP | 2007-108269 | 4/2007 |
| JP | A-2007-086449 | 4/2007 |
| JP | 2007-304135 | 11/2007 |
| JP | A-2008-164748 | 7/2008 |
| JP | 2009-104007 | 5/2009 |

* cited by examiner

*Primary Examiner* — Walter L Lindsay, Jr.
*Assistant Examiner* — Roy Y Yi
(74) *Attorney, Agent, or Firm* — Ostrolenk Faber LLP

(57) ABSTRACT

A cleaning apparatus is provided with a cleaning roller that is positioned so as to be in contact with a photosensitive drum, and with a toner layer thickness regulating member that regulates the thickness of a toner layer adhering to the surface of this cleaning roller. The toner layer thickness regulating member is formed by a toner layer thickness regulating roller that rotates in contact with the cleaning roller.

22 Claims, 4 Drawing Sheets

PRIOR ART

CLEANING APPARATUS AND IMAGE FORMING APPARATUS

BACKGROUND OF THE INVENTION

1. Field of the Invention

The present invention relates to a cleaning apparatus that is used in an image forming apparatus such as a copy machine or printer, and also relates to an image forming apparatus that is provided with this cleaning apparatus.

Priority is claimed on Japanese Patent Application No. 2009-295799, filed Dec. 25, 2009 and Japanese Patent Application No. 2009-295800, filed Dec. 25, 2009, the contents of which are incorporated herein by reference.

2. Description of Related Art

In an image forming apparatus such as a copy machine or printer, a photosensitive drum is provided in an image forming section. An electrostatic latent image is formed on the surface of this photosensitive drum, and toner is then adhered thereto resulting in a toner image being formed.

The toner image is then transferred onto a transfer body such as copy paper, however, the toner does not get completely transferred and a portion thereof may remain on the surface of the photosensitive drum. Alternatively, electrical discharge product that is produced during the forming of the electrostatic latent image may remain adhered to the surface of the photosensitive drum. This residual toner or electrical discharge product prevents (impedes) the forming of new images, and is a main cause for superior transfer images not being obtained. Because of this, a cleaning apparatus that is used to remove adhesion material (i.e., toner, electrical discharge product, and the like) from the surface of the photosensitive drum is provided in the image forming apparatus.

FIG. 5 is a schematic cross-sectional view of a conventional cleaning apparatus.

In a cleaning apparatus (a) there are provided a cleaning blade (c) that scrapes adhesion material from the surface of the photosensitive drum (b), a cleaning roller (d) that rotates while in contact with the photosensitive drum (b), and a collect screw (e) that collects (recovers) the removed adhesion material.

The cleaning roller (d) that is in contact with the photosensitive drum (b) not only has a function of removing toner, but also has functions of holding toner so as to form a toner layer on the surface of the cleaning roller (d), and polishing the surface of the photosensitive drum (b).

However, in the conventional cleaning apparatus (a), because the amount of toner held on the cleaning roller (d) is not constant, keeping the thickness of the toner layer formed on the surface of the cleaning roller (d) uniform has proved problematic. Accordingly, in the cleaning apparatus (a) having the above described structure, it has not been possible to consistently polish a photosensitive drum.

In order to solve the above described problem, a cleaning apparatus has been developed in which toner that has been removed from the photosensitive drum by a cleaning blade is accumulated (collected) in a toner receive (receive member, receptacle) that is provided underneath the cleaning roller.

In this apparatus, toner remaining on the surface of the photosensitive drum is scraped off using a cleaning blade, and the scraped off toner is accumulated in a toner receive that is provided underneath the cleaning roller, and the collected toner is then held on the cleaning roller so that the surface of the photosensitive drum can be polished.

By providing the toner receive underneath the cleaning roller, a sufficient quantity of toner can be supplied to the cleaning roller to be held thereon, so that the polishing effect can be improved as a result.

However, if an excessive quantity of toner is adhering to the surface of the photosensitive drum, the quantity of toner that is accumulated in the toner receive also becomes excessive, and there is a possibility that the quantity of toner held on the cleaning roller will become too great and will re-adhere to the photosensitive drum. Moreover, if the toner quantity adhered on the surface of the photosensitive drum is too small, then sufficient polishing cannot be achieved and it becomes necessary to supply toner.

Accordingly, because the polishing effect varies as the toner quantity increases and decreases, it is difficult to achieve consistent polishing.

In contrast, a cleaning apparatus has been developed that is provided with a toner receive that is provided underneath the cleaning roller, and with a scraper that is used to scrape off toner held on the cleaning roller.

In this apparatus, toner accumulated in the toner receive is held on the cleaning roller, and the toner is scraped off using a scraper so that the toner quantity can be adjusted.

Because it is thus possible to supply a sufficient quantity of toner to the cleaning roller, and because the toner quantity can be adjusted by being scraped off, the quantity of toner held on the cleaning roller has no effect on the print coverage and the polishing effect is generally consistent (substantially unchanging).

However, there is a possibility that the above described scraper will remove too much of the toner held on the cleaning roller, and in this case the problem arises that friction between the cleaning roller and the scraper causes the toner to become fused to the respective members.

Furthermore, if this apparatus is used for a lengthy period of time, the problems arises that portions of the scraper become worn away and uniform polishing is no longer possible. Namely, as a result of portions of the scraper being worn away, it is no longer possible to adjust the quantity of toner on the cleaning roller and the thickness of the toner layer on the cleaning roller increases. Because of this, the polishing of the surface of the photosensitive drum becomes excessive.

Moreover, because the toner layer is thinner in those areas which are scraped by the non-worn portions of the scraper than those in areas which are scraped by the worn portions of the scraper, the pressing force with which the cleaning roller presses against the photosensitive drum is reduced and sufficient polishing is not possible. Accordingly, it is difficult to consistently polish a photosensitive drum over an extended period of time.

SUMMARY OF THE INVENTION

It is an object of aspects of the present invention to provide a cleaning apparatus and an image forming apparatus that, even when the quantity of toner supplied to a cleaning roller varies, make it possible to adjust the thickness of a toner layer that is formed on the surface of the cleaning roller and thereby consistently polish the surface of a photosensitive drum, and to also perform consistent polishing of a photosensitive drum over an extended period of time without the members forming the cleaning apparatus becoming worn.

The cleaning apparatus according to an aspect of the present invention is provided with a cleaning roller that is positioned so as to be in contact with a photosensitive drum, and with a toner layer thickness regulating member that regulates the thickness of a toner layer adhering to the surface of this cleaning roller, wherein the toner layer thickness regulating member is formed by a toner layer thickness regulating roller that rotates in contact with the cleaning roller.

In the above described aspect, it is also possible for rotation directions of the toner layer thickness regulating roller and the cleaning roller to be the same direction at the point of contact between the two rollers.

In the above described aspect, it is also possible for the linear velocity of the toner layer thickness regulating roller to be between 0.8 and 1.2 times that of the cleaning roller.

In the above described aspect, it is also possible for the depth to which the toner layer thickness regulating roller presses into the cleaning roller to be between 0.2 and 0.6 mm.

In the above described aspect, it is also possible for the outer diameter of the toner layer thickness regulating roller to not be an integral multiple of the outer diameter of the cleaning roller.

In the above described aspect, it is also possible for the outer diameter of the toner layer thickness regulating roller to be smaller than the outer diameter of the cleaning roller.

In the above described aspect, it is also possible for the toner layer thickness regulating roller to be a foaming body roller or a brush roller.

In the above described aspect, it is also possible for the toner layer thickness regulating roller to be a foaming body roller, and for the hardness of the foaming body roller to be less than that of the cleaning roller.

In the above described aspect, it is also possible for the toner layer thickness regulating roller to be a metal roller that rotates in contact with the cleaning roller.

In the above described aspect, it is also possible for rotation directions of the metal roller and the cleaning roller to be the same direction at the point of contact between the two rollers.

In the above described aspect, it is also possible for a ratio (X) of the linear velocity of the metal roller relative to that of the cleaning roller to be set such that $0<X\leqq 2$.

In the above described aspect, it is also possible for the depth to which the metal roller presses into the cleaning roller to be between 0.2 and 0.6 mm.

In the above described aspect, it is also possible for the outer diameter of the metal roller to not be an integral multiple of the outer diameter of the cleaning roller.

In the above described aspect, it is also possible for the outer diameter of the metal roller to be smaller than the outer diameter of the cleaning roller.

In the above described aspect, it is also possible for processing to create an uneven surface to be performed on the metal roller.

In the above described aspect, it is also possible for the surface of the metal roller to be covered by a synthetic resin.

In the above described aspect, it is also possible for the outermost layer of the photosensitive drum to be amorphous silicon.

An image forming apparatus according to a further aspect of the present invention is provided with the above described cleaning apparatus.

DETAILED DESCRIPTION OF THE EMBODIMENTS

Hereinafter, a cleaning apparatus and image forming apparatus according to embodiments of the present invention will be described with reference made to the drawings.

Figure 1:
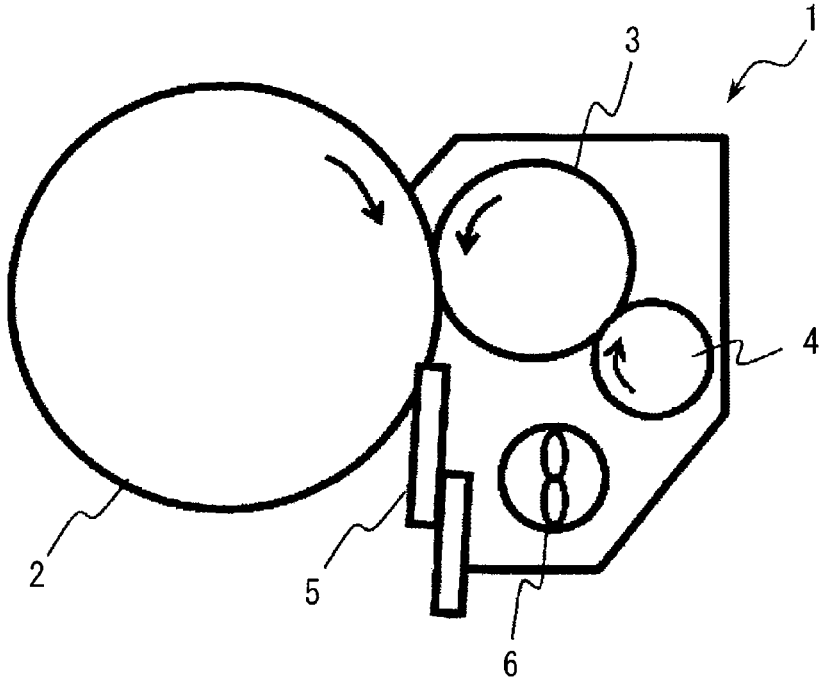
FIG. 1 is a schematic cross-sectional view showing a cleaning apparatus.

FIG. 1 is a schematic structural view showing a cleaning apparatus (1) of an embodiment of the present invention.

A cleaning apparatus (1) is provided with a cleaning roller (3) that is provided facing a photosensitive drum (2) and that rotates in contact with the photosensitive drum (2), a toner layer thickness regulating roller (4) that rotates in contact with the cleaning roller (3), a cleaning blade (5) that scrapes adhesion material (i.e., toner, electrical discharge product, and the like) from the surface of the photosensitive drum (2), and a collect screw (6) that collects adhesion matter removed from the photosensitive drum (2). Note that in FIG. 1, the arrows depicted inside the photosensitive drum (2), the cleaning roller (3), and the toner layer thickness regulating roller (4) show the respective roller rotation directions.

It is preferable for the placement position of the toner layer thickness regulating roller (4) to be slightly below that of the cleaning roller (3), as is shown in FIG. 1, as this enables the size of the cleaning apparatus (1) to be reduced, however, it is not essential for the toner layer thickness regulating roller (4) to be in this position and it is only necessary for it to be in contact with the cleaning roller (3).

Foaming rubbers or sponges are typically used for the roller material. It is difficult to make toner particles adhere firmly to the roller surfaces by the foaming rubbers or sponges, however, if metal is used, and then the toner particles can be made to adhere reliably and firmly to the roller surfaces.

By causing the toner layer thickness regulating roller (4) to rotate in contact with the cleaning roller (3), then even if the quantity of toner that is supplied to the cleaning roller (3) varies, it is still possible to cause a fixed quantity of toner to be held on the cleaning roller (3) in both the circumferential direction and the axial direction thereof, and to form a toner layer having a uniform thickness. Namely, the cleaning roller (3) and the toner layer thickness regulating roller (4) both hold toner, and rubbing is generated between these rollers whose surface layers are covered by the toner.

Accordingly, wear of the cleaning roller (3) and the toner layer thickness regulating roller (4) is prevented, and it is possible to prevent any abrasion damage to the rollers even when they are used for extended periods.

Moreover, if metal is used, because this provides superior durability, it is difficult for wear and damage to occur even if the rollers are used for extended periods, and the thickness of the toner layer of the cleaning roller (3) can be adjusted and the photosensitive drum (2) can be polished for stability (with consistency).

It is preferable for the toner layer thickness regulating roller (4) to be rotating in the same direction as the cleaning roller (3) at the point of contact between the two rollers (see FIG. 1). By employing this type of structure, compared with when they are rotating in mutually opposite directions, it is possible to reduce the load applied by the toner layer thickness regulating roller (4) to the cleaning roller (3), and wear of the cleaning roller (3) can be prevented (reduced).

It is preferable for the linear velocity of the toner layer thickness regulating roller (4) to be set to between 0.8 and 1.2 times that of the cleaning roller (3).

If the linear velocity of the toner layer thickness regulating roller (4) is outside a range of between 0.8 and 1.2 times that of the cleaning roller (3), the relative linear velocity difference becomes too great, and the polishing force between the two rollers increases so that there is a possibility of increased wear of the cleaning roller (3) occurring, which is unfavorable.

Moreover, if a metal is used for the material forming the rollers, then it is preferable for the ratio (X) of the linear velocity of the toner layer thickness regulating roller (4) relative to that of the cleaning roller (3) to be set such that $0<X\leqq 2$.

If the ratio (X) of the linear velocity of the toner layer thickness regulating roller (4) relative to that of the cleaning roller (3) is outside a range of $0<X\leqq 2$, the relative linear velocity difference becomes too great, and the polishing force between the two rollers increases so that there is a possibility of increased wear of the cleaning roller (3) occurring, which is unfavorable.

It is preferable for the toner layer thickness regulating roller (4) to be pressed so that it presses (or encroaches) into the cleaning roller (3). The depth to which the toner layer thickness regulating roller (4) presses into the cleaning roller (3) is between 0.2 and 0.6 mm. Within this range, even if the positions of the cleaning roller (3) and the toner layer thickness regulating roller (4) change, they will still be rotating in constant contact with each other, and the thickness of the toner layer will be able to be adjusted.

If the pressing depth is less than 0.2 mm, the rubbing between the cleaning roller (3) and the toner layer thickness regulating roller (4) is insufficient, so that it is not possible to adjust the thickness of the toner layer formed on the surface of the cleaning roller (3), which is unfavorable. If, on the other hand, the pressing depth is greater than 0.6 mm, toner that is adhering to the cleaning roller (3) is strongly pressed by the toner layer thickness regulating roller (4), and the thickness of the toner layer becomes too thin. In addition to this, the drive torque and the bend (flexure) in the axial direction of the cleaning roller (3) become too large, so that this is unfavorable as well.

The size of the toner layer thickness regulating roller (4) is not particularly restricted, however, it is preferable for the length in the axial direction thereof to be substantially the same as the length of the cleaning roller (3). By employing this type of structure, the toner layer thickness regulating roller (4) is in contact with the cleaning roller (3) over the entire length in the axial direction thereof, and the surface of the cleaning roller (3) can be rubbed efficiently.

Moreover, it is preferable for the outer diameter of the toner layer thickness regulating roller (4) to be set such that it is not an integral multiple of the outer diameter of the cleaning roller (3).

If the outer diameter of the toner layer thickness regulating roller (4) is set so that it is not an integral multiple of the outer diameter of the cleaning roller (3), then the contact positions are not always the same when the two rollers are rotating. Accordingly, ununiformity in the thickness of the toner layer in the circumferential direction of the cleaning roller (3) can be prevented and the toner layer thickness can be made uniform.

It is preferable for the outer diameter of the toner layer thickness regulating roller (4) to be set smaller than the outer diameter of the cleaning roller (3).

If the outer diameter of the toner layer thickness regulating roller (4) is set smaller than the outer diameter of the cleaning roller (3), then because the radius of curvature of the toner layer thickness regulating roller (4) is smaller, the contact area between the two rollers is also smaller, and the pressure in the mutually abutting portions (i.e., the contact portion) is accordingly increased. Because of this, the cleaning roller (3) deforms so as to follow the circumferential surface of the toner layer thickness regulating roller (4) as it presses against it, and this results in the followability of the toner layer thickness regulating roller (4) relative to the cleaning roller (3) being improved. Accordingly, it becomes possible to form a toner layer having a uniform thickness over the entire circumferential direction and axial direction of the cleaning roller (3).

If the outer diameters of the cleaning roller (3) and the toner layer thickness regulating roller (4) are the same, or if the outer diameter of the toner layer thickness regulating roller (4) is larger than the outer diameter of the cleaning roller (3), then because the contact area increases, the pressure applied to the point of contact (the touched portion) between the cleaning roller (3) and the toner layer thickness regulating roller (4) decreases, and thus there is no improvement in cleaning roller followability, and it is difficult to form a uniform toner layer over the entire cleaning roller (3).

The thickness of the toner layer formed on the surface of the cleaning roller (3) is preferably between 5 and 60 μm, and between 5 and 20 μm is more preferable.

If the thickness is less than 5 μm, then it is not possible to properly polish the photosensitive drum (2), while if the thickness exceeds 60 μm, then defects such as pinholes and the like occur, or toner may become re-adhered to the photosensitive drum (2) and each of these instances are unfavorable.

It is also possible for a polishing agent such as titanium oxide ($TiO_2$) or the like to be added to the toner.

If a polishing agent is added, the toner that includes the polishing agent is held on the cleaning roller (3) and forms a toner layer, and the toner layer is adjusted to a uniform thickness by the toner layer thickness regulating roller (4). Accordingly, the surface of the photosensitive drum (2) is uniformly polished by this cleaning roller (3).

Figure 2:
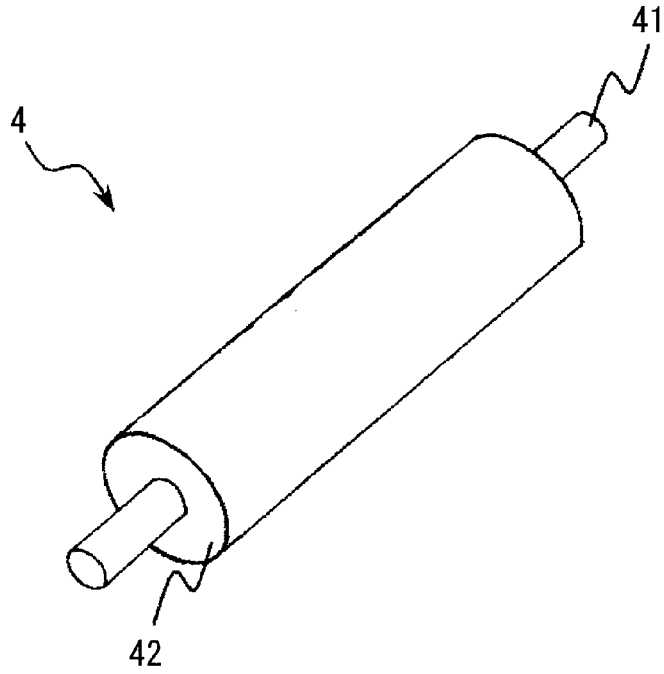
FIG. 2 is a perspective view showing a toner layer thickness regulating roller that is used in a cleaning apparatus.

FIG. 2 is a perspective view showing the toner layer thickness regulating roller (4) that is used in the cleaning apparatus (1).

The toner layer thickness regulating roller (4) is formed by a rotation shaft (41), and a toner holding member (42) that is provided around the circumference of the rotation shaft (41).

The toner holding member (42) has a circular column shape and, provided that it is capable of holding toner, the material used to form it is not particularly restricted, however, a foaming body or brush are favorably used. The toner layer thickness regulating roller (4) shown in typical view in the drawing is a foaming body roller which employs a foaming body. A brush roller may be formed by embedding fibers of synthetic resin in a shaft, and then providing these fibers over the entire circumferential and axial directions of a rotation shaft (41).

Examples of the material used to form the foaming body include ethylene propylene diene monomers (EPDM), butadiene acrylonitrile copolymers (NBR), urethane, silicon rubber, and the like.

Examples of the material used to form the brushes include nylon, polyester, polyethylene terephthalate, acrylic resins, rayon, and the like.

By forming the toner holding member (42) into a roller shape using one of the above described materials, it can be made to hold toner and to also rub the surface of the cleaning roller (3) so that the thickness of the toner layer can be adjusted.

When a foaming body is used for the toner holding member (42) so as to form a foaming body roller, then one that has a lower hardness than that of the cleaning roller (3) is used.

By making the hardness of the toner layer thickness regulating roller (4) lower than the hardness of the cleaning roller (3), the toner layer thickness regulating roller (4) is deformed when it is pressed against the cleaning roller (3). Accordingly, the followability of the toner layer thickness regulating roller (4) relative to the cleaning roller (3) is improved, and even if irregularities are formed due to adhesions of toner or electrical discharge products to the surface of the cleaning roller (3), the rubbing of the toner layer thickness regulating roller (4) is able to conform to these irregularities and the thickness of the toner layer can be adjusted.

Additionally, when metal is used for the material of the toner holding member (42), hereinafter, the toner layer thickness regulating roller (4) is referred to where appropriate as a metal roller (4), and the toner holding member (42) is referred to where appropriate as metal (42).

FIG. 2 is also a perspective view showing the metal roller (4) that is used in the cleaning apparatus (1).

The metal roller (4) has a circular column shape and is formed by a rotation shaft (41), and metal (42) that is provided around the circumference of the rotation shaft (41).

The type of metal that is used is not particularly restricted, and stainless steel (SUS), aluminum (Al) and the like are used.

The metal roller (4) may be used in an unmodified circular column shape, however, it is preferable for processing to create an uneven surface to be performed thereon. Examples of this uneven surface processing include knurling processing, blast processing, thread groove processing and the like. By performing this uneven surface processing, even if there is unevenness in the toner layer thickness of the cleaning roller (3), it is still possible to move the toner in the axial direction of the cleaning roller (3) so that a uniform toner layer can be formed.

Moreover, it is also preferable for the surface of the metal roller (4) to be covered by a synthetic resin. By employing such a structure, the metal does not make direct contact with the cleaning roller (3). As a result, it is possible to prevent the cleaning roller (3) becoming worn because of pressure-contact from the metal roller (4). Accordingly, even after an extended period of use, it is possible to prevent abrasion damage to the cleaning roller (3).

The synthetic resin that is used in covering the surface of the metal roller (4) is not particularly restricted provided that it is not melted by friction heat generated from the rubbing, and polyethylene-based resins, silicone-based resins, and fluorine-based resins and the like are favorably used.

A known method may be used for the covering method and examples thereof include coating, and dipping (immersion) of the metal roller (4) in molten resin, and the like.

The material used to form the outermost layer of the photosensitive drum (2) with which the cleaning roller (3) comes into contact is not particularly restricted, and amorphous silicon and organic photoconductors (OPC) and the like can be used.

When the cleaning apparatus (1) according to the embodiments of the present invention is used, it is possible to perform consistent and satisfactory polishing even if a photosensitive drum (2) that is provided with an outermost layer formed from amorphous silicon is used, and there is no concern that image defects (i.e., image deletion and dash marks and the like) will occur during image formation.

Figure 3:
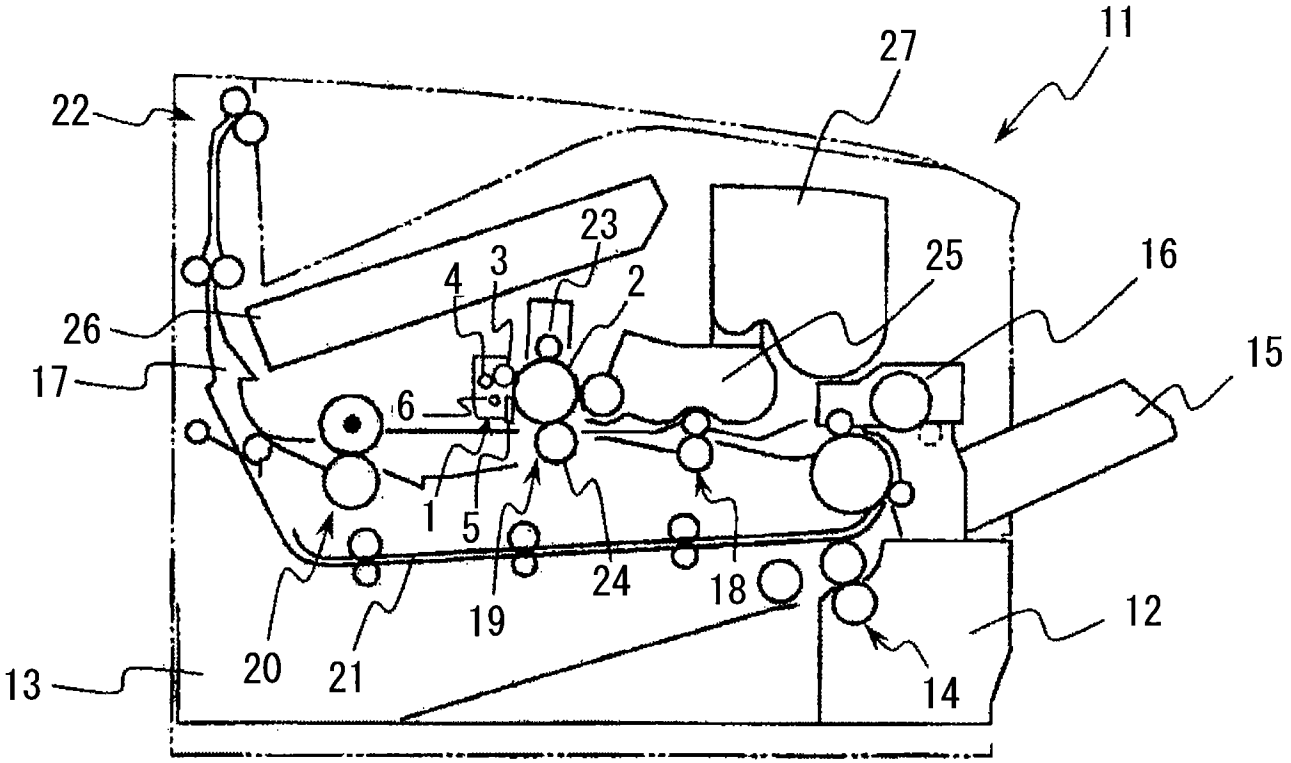
FIG. 3 is schematic cross-sectional view showing an image forming apparatus.

FIG. 3 is a schematic cross-sectional view showing an image forming apparatus of an embodiment of the present invention.

The image forming apparatus shown in the drawing is a printer, however, the image forming apparatus may also be a copy machine or fax machine.

The image forming apparatus according to an embodiment of the present invention is provided with the above described cleaning apparatus (1).

The image forming apparatus shown in the drawing is provided with a paper feed cassette (12) that is housed inside a printer main body (11), a paper feed section (14) that extracts copy paper (not shown) which is housed in a storage space (13) in the paper feed cassette (12), a manual feed tray (15) that is located in front of the printer main body (11), a manual paper feed section (16) that extracts copy paper (not shown) which has been set in the manual feed tray (15), a conveying path (17) along which copy paper fed from the respective paper feed sections 14 and 16 is conveyed, a pair of register rollers (18) that are located on the downstream side in the paper conveying direction from a merging portion of the respective paper feed sections 14 and 16, an image forming section (19) that is located on the downstream side in the paper conveying direction from the pair of register rollers (18), a fixing apparatus (20) that fixes images (i.e., toner images) and is located on the downstream side in the paper conveying direction from the image forming section (19), an reversing path (21) that returns the copy paper to the upstream side in the paper conveying direction, and a paper discharge section (22) that is provided in a termination portion of the conveying path (17).

The image forming section (19) is provided with the photosensitive drum (2), and with the cleaning apparatus (1), a charging apparatus (23), a transfer apparatus (24), a developing apparatus (25), and an exposure apparatus (26) that are placed around the photosensitive drum (2).

As a result, in the image forming section (19) the photosensitive drum (2) is driven to rotate at a predetermined processing speed (i.e., circumferential speed) by a drive device (not shown), and the surface thereof is uniformly charged to a predetermined polarity/potential by the charging apparatus (23).

An electrostatic latent image is formed by the exposure apparatus (26) on the surface of the photosensitive drum (2) after it has been charged. The exposure apparatus (26) irradiates laser light (not shown) onto the surface of the photosensitive drum (2), and thereby removes the charge from the laser light irradiated portion on the surface of the photosensitive drum (2) so as to form an electrostatic latent image that corresponds to the image information.

Charged toner supplied from a toner container (27) is electrostatically adhered to the electrostatic latent image that is formed on the surface of the photosensitive drum (2) so that this is developed by the developing apparatus (25) as a toner image. This toner image is then transferred as a transfer image onto copy paper by the transfer apparatus (24). At this time, residual toner and electrical discharge products and the like are removed by the cleaning apparatus (1) from the photosensitive drum that has transferred the toner image onto the copy paper, and static elimination processing is performed as preparation for the charging of the next image formation by a static elimination apparatus (not shown).

In the image forming apparatus according to an embodiment of the present invention, because the surface of the photosensitive drum (2) is polished consistently without the cleaning roller (3) becoming worn even after an extended period of use, there is no occurrence of faults such as pinholes, and image defects (i.e., image deletion and dash marks and the like) do not occur in this image forming apparatus.

Hereinafter, examples relating to the cleaning apparatus of an embodiment of the present invention will be given.

It should be noted, however, that the present invention is not limited to these embodiments.

Example 1

A cleaning apparatus according to an embodiment of the present invention was loaded (mounted) in an image forming apparatus (a TASK alfa 500ci), and the thickness of the toner layer formed on the cleaning roller after printing was evaluated.

A cleaning apparatus provided with the structure shown in FIG. 1 was used, and urethane foaming rubber (having an outer diameter of 15.5 mm and a thickness of 1.75 mm) was used for the cleaning roller, a urethane rubber plate (having a thickness of 2.2 mm) was used for the cleaning blade, and a sponge roller (made of urethane having an outer diameter of 11 mm and a thickness of 1.5 mm) was used for the toner layer thickness regulating roller. Moreover, the outermost layer of the photosensitive drum was formed from amorphous silicon, and titanium oxide ($TiO_2$) was externally added to the toner.

The linear velocity of the photosensitive drum was set to 210 mm/sec, and the linear velocity of the cleaning roller was set to 168 min/sec.

The rotation directions of the cleaning roller and toner layer thickness regulating roller were the same direction at the point where the two rollers contacted each other, and continuous printing of 10,000 sheets of A4 copy paper (i.e., transfer paper) at a print coverage of 2% was performed. The thickness of the toner layer in five locations in the axial direction of the cleaning roller was then measured, and the mean value thereof was calculated. A laser diameter gauge was used to measure the toner layer thickness, and the outer diameter of the roller was measured both when the toner was still adhered thereto, and when the toner had been air-blown therefrom. The difference between the measured values was taken as the toner layer thickness.

The depths to which the toner layer thickness regulating roller was pressed into the cleaning roller were set to 0.2 mm, 0.4 mm, and 0.6 mm, and were taken respectively as Examples 1 to 3.

Moreover, the above described printing operation was also performed without the toner layer thickness regulating roller being provided, and this was used as Comparative example 1. The same printing operation other than that a scraper was provided instead of the toner layer thickness regulating roller was also performed and this was used as Comparative example 2.

Figure 4:
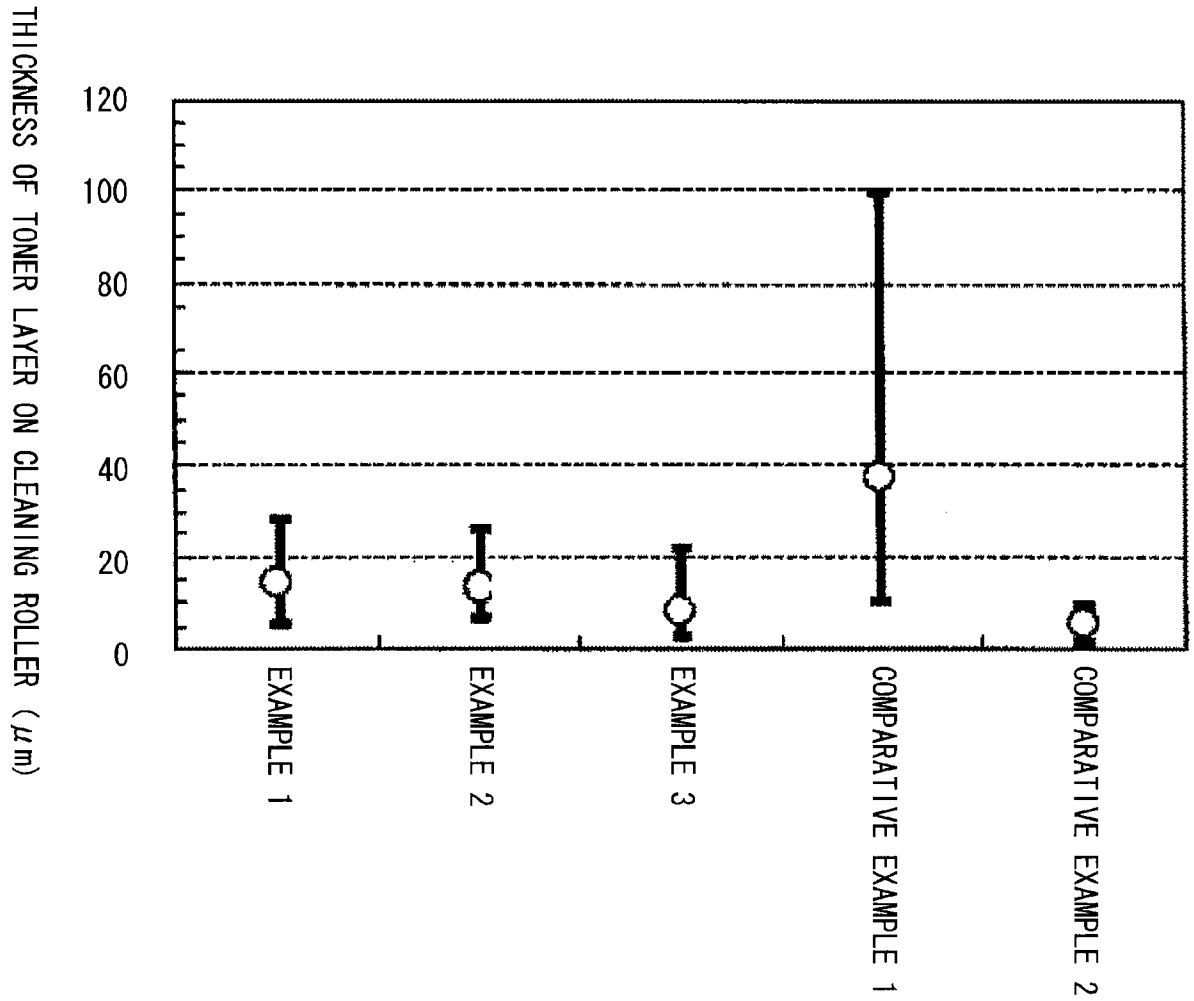
FIG. 4 is a graph showing measurement results obtained for the thickness of the toner layer formed on the cleaning roller surface.
Figure 5:
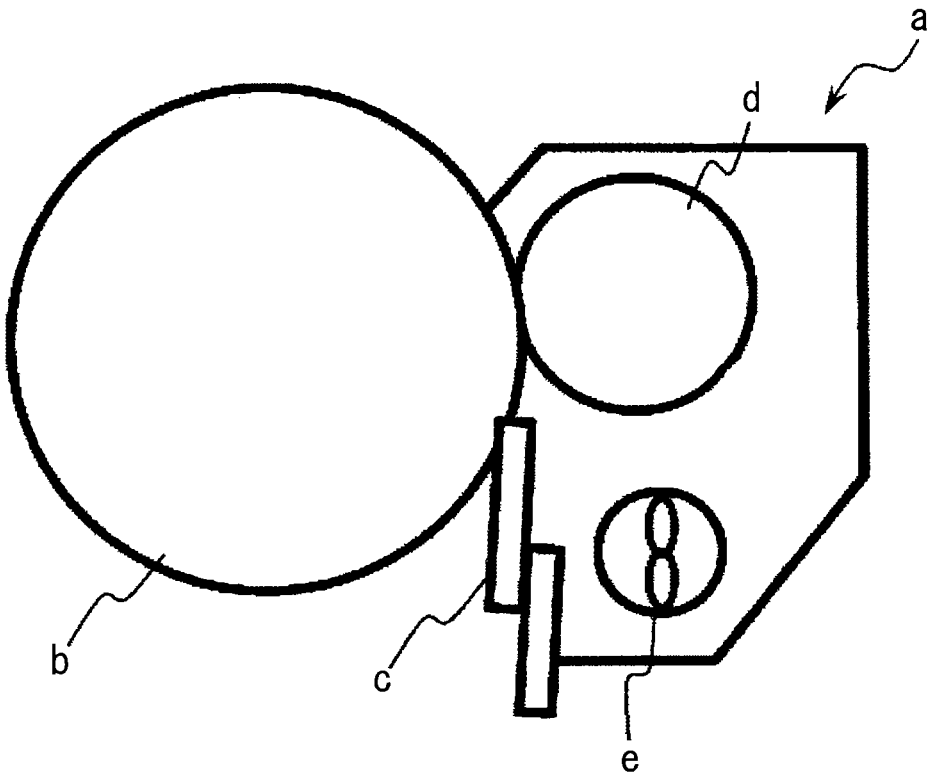
FIG. 5 is a schematic cross-sectional view showing a conventional cleaning apparatus.

The results are shown in Table 1 and FIG. 4.

TABLE 1

| | Cleaning roller toner layer thickness (μm) | | |
|---|---|---|---|
| | Maximum | Mean | Minimum |
| Example 1 | 28.1 | 14.5 | 5.5 |
| Example 2 | 26.4 | 13.5 | 6.9 |
| Example 3 | 21.9 | 8.6 | 2.8 |
| Comparative example 1 | 100.2 | 37.9 | 10.6 |
| Comparative example 2 | 9.6 | 5.7 | 1.8 |

In Comparative example 1 in which members were not provided to adjust the thickness of the toner layer such as a toner layer thickness regulating roller or a scraper, it was found that the mean toner layer thickness was reasonably thick at approximately 38 μm. Moreover, variability in the thickness of between 10 and 100 μm was observed in the axial direction of the cleaning roller.

Moreover, in Comparative example 2 in which a scraper was used instead of the toner layer thickness regulating roller, it was found that the mean toner layer thickness was extremely thin at approximately 6 μm.

In contrast to this, in Examples 1 through 3, there were little variability in the thickness in the axial direction of the cleaning roller, and it was found that the mean toner layer thickness was substantially constant at approximately 10 μm.

When there are considerable irregularities in the cleaning roller toner layer thickness as in Comparative example 1, then polishing unevenness occurs in the photosensitive drum and it is easy for pinholes to be generated. Moreover, there is a possibility that toner will become re-adhered to the photosensitive drum.

In Comparative example 2, although there was substantially no evidence of irregularities in the toner layer thickness in the axial direction of the cleaning roller, because the toner layer thickness is very thin the quantity of toner being held on the cleaning roller is small, so that it is not possible to satisfactorily polish the photosensitive drum and it is easy for image defects to occur.

Compared with Comparative examples 1 and 2, in Examples 1 through 3 there is an appropriate toner layer thickness, and this thickness is substantially uniform over the entire length in the axial direction of the cleaning roller. Accordingly, it is possible to effectively polish the surface of the photosensitive drum.

Example 2

A cleaning apparatus provided with the structure shown in FIG. 1 was used, and the thickness of toner layers formed on the cleaning roller was evaluated. An EPDM foaming body (having an outer diameter of 15 mm and a thickness of 2 mm) was used for the cleaning roller, a urethane rubber plate (having a thickness of 2.2 mm) was used for the cleaning blade, and a brush roller (made of conductive nylon at 120 KF/inch2, 330T/48F, and having a shaft of 6 mm and a bristle length of 3 mm) was used for the toner layer thickness regulating roller. Moreover, the outermost layer of the photosensitive drum was formed from amorphous silicon, and titanium oxide ($TiO_2$) was externally added to the toner.

The rotation directions of the cleaning roller and toner layer thickness regulating roller were the same direction at the point where the two rollers contacted each other, and the development of a solid pattern having a width of 50 mm in the circumferential direction of the photosensitive drum was performed 500 times with toner being supplied to the cleaning roller.

In the above described conditions, the cleaning roller and the toner layer thickness regulating roller were both rotated at the same speed.

A toner layer was formed with the toner layer thickness regulating roller being placed (installed) and this was taken as Example 4. A toner layer was also formed without the toner layer thickness regulating roller being placed and this was taken as Comparative example 3.

Note that one end of the toner layer thickness regulating roller was set as 0 mm, and the toner layer thickness was measured at distances of 30 mm, 60 mm, 90 mm, 120 mm, and 150 mm in the axial direction therefrom.

The results are shown in Table 2.

TABLE 2

| Distance (mm) | Cleaning roller toner layer thickness (μm) Example 4 | Comparative example 3 |
|---|---|---|
| 0 | 50 | 50 |
| 30 | 45 | 100 |
| 60 | 40 | 40 |
| 90 | 35 | 70 |
| 120 | 45 | 60 |
| 150 | 45 | 30 |

In Comparative example 3 in which the toner layer thickness regulating roller was not provided, it was found that irregularities were generated in the toner layer thickness in the axial direction of the cleaning roller.

In contrast to this, in Example 4 in which the toner layer thickness regulating roller was used, it was confirmed that a uniform toner layer was formed in the axial direction of the cleaning roller.

Example 3

A toner layer was formed on a cleaning roller using the same method as that employed in Example 2. After the cleaning roller and the toner layer thickness regulating roller had been rotated at different speeds, the toner layer thickness was measured. The thickness of the toner layer was measured in five locations in the axial direction of the cleaning roller, and the mean value thereof was calculated.

The linear velocity of the photosensitive drum was set to 210 mm/sec, and the linear velocity of the cleaning roller was set to 168 mm/sec. The toner layer thickness regulating roller was then rotated at linear velocities of 0.6, 0.8, 1 (i.e., in slave rotation), 1.2, and 1.4 times that of the cleaning roller.

The results are shown in Table 3.

TABLE 3

| Linear velocity ratio relative to that of cleaning roller | Mean value of cleaning roller toner layer thickness (μm) |
|---|---|
| 0.6 | 15 |
| 0.8 | 30 |
| 1 | 45 |
| 1.2 | 35 |
| 1.4 | 20 |

From Table 3 it was found that as the difference in velocity relative to that of the cleaning roller increased, the toner layer thickness became thinner. From this fact it was confirmed that it is possible to adjust the toner layer thickness by creating a difference in velocities.

Example 4

SUS (SUS 304 having an outer diameter of 8 mm) was used for the toner layer thickness regulating roller (i.e., a metal roller), and the same type of experiment as the Example 3 was conducted.

Note that the linear velocity of the metal roller was set to 0.5, 1 (i.e., slave rotation), and 2 times that of the cleaning roller.

The results are shown in Table 4.

TABLE 4

| Linear velocity ratio relative to that of cleaning roller | Cleaning roller toner layer thickness (μm) |
|---|---|
| 0.5 | 30 |
| 1 | 40 |
| 2 | 10 |

By rotating the metal roller in contact with the cleaning roller, it was found that were substantially no irregularities in thickness in the axial direction of the cleaning roller, and it was found that a toner layer having a uniform thickness was able to be formed.

Moreover, it was conformed that as the difference in velocity decreased, the toner layer thickness became thicker, and as the difference in velocity increased, the toner layer thickness became thinner. From this fact it became clear that it is possible to adjust the toner layer thickness by creating a difference in the velocities thereof when the cleaning roller and the metal roller are rotated.

As mentioned above, according to the cleaning apparatus of an embodiment of the present invention, by providing the cleaning apparatus with a cleaning roller that is positioned so as to be in contact with the photosensitive drum, and with a toner layer thickness regulating member that regulates the thickness of a toner layer adhering to the surface of this cleaning roller, and by forming the toner layer thickness regulating member as a toner layer thickness regulating roller that rotates in contact with the cleaning roller, even if the quantity of toner supplied to the cleaning roller varies, it is still possible to adjust the quantity of toner that is held on the surface of the cleaning roller and adjust the thickness of the toner layer that is formed. Namely, it is possible to hold a fixed quantity of toner in both the circumferential direction and the axial direction of the cleaning roller, and a toner layer having a uniform thickness can be formed. Accordingly, it is possible to provide a cleaning apparatus that is capable of uniformly polishing the surface of a photosensitive drum.

Moreover, because toner is held on both the toner layer thickness regulating roller and the cleaning roller with which the toner layer thickness regulating roller comes into contact, and rubbing is generated between these rollers whose surface layers are covered by the toner, it is possible to prevent wear of the toner layer thickness regulating roller and the cleaning roller, and it is possible to stably polish a photosensitive drum without causing any abrasion damage to the rollers even after extended use.

Moreover, by forming the toner layer thickness regulating member as a metal roller that rotates in contact with the cleaning roller, even if toner is firmly adhered to the surface of the metal roller and if the quantity of toner supplied to the cleaning roller varies, it is still possible to adjust the quantity of toner that is held on the surface of the cleaning roller and to adjust the thickness of the toner layer that is formed. Namely, it is possible to hold a fixed quantity of toner in both the circumferential direction and the axial direction of the cleaning roller.

Moreover, because the metal roller can be pressed to the cleaning roller with greater pressing force compared with foaming rubber or the like which is the normal material used for rollers, it is possible to form a toner layer having a uniform thickness. Accordingly, it is possible to create a cleaning apparatus which is capable of uniformly polishing the surface of a photosensitive drum.

In addition, because toner is held on both the metal roller and on the cleaning roller with which the metal roller comes into contact, and because rubbing is generated between these rollers whose surface layers are covered by the toner, it is possible to prevent wear of the cleaning roller. Furthermore, because a metal roller has superior durability, it is possible to stably adjust the thickness of a toner layer on the cleaning roller and polish a photosensitive drum even after extended use.

The present invention is used in image forming apparatuses that are provided with a cleaning apparatus such as printers, copy machines, and fax machines.

What is claimed is:

1. A cleaning apparatus for a photosensitive drum, the cleaning apparatus comprising:

a cleaning roller that is positioned so as to be in contact with the photosensitive drum;

a toner layer thickness regulating member that regulates a thickness of a toner layer adhering to the surface of the cleaning roller; and the toner layer thickness regulating member comprises a toner layer thickness regulating roller that rotates in contact with the cleaning roller, wherein a depth to which the toner layer thickness regulating roller presses into the cleaning roller is in a range of 0.2 to 0.6 mm.

2. The cleaning apparatus according to claim 1, wherein rotation directions of the toner layer thickness regulating roller and the cleaning roller are the same direction at the point of contact between the two rollers.

3. The cleaning apparatus according to claim 2, wherein the linear velocity of the toner layer thickness regulating roller is between 0.8 and 1.2 times that of the cleaning roller.

4. The cleaning apparatus according to claim 1, wherein an outer diameter of the toner layer thickness regulating roller is not an integral multiple of the outer diameter of the cleaning roller.

5. The cleaning apparatus according to claim 1, wherein an outer diameter of the toner layer thickness regulating roller is smaller than the outer diameter of the cleaning roller.

6. The cleaning apparatus according to claim 1, wherein an outermost layer of the photosensitive drum is amorphous silicon.

7. The cleaning apparatus according to claim 1, wherein the toner layer thickness regulating roller is a foaming body roller or a brush roller.

8. The cleaning apparatus according to claim 7, wherein the toner layer thickness regulating roller is a foaming body roller, and a hardness of the foaming body roller is less than that of the cleaning roller.

9. The cleaning apparatus according to claim 1, wherein the toner layer thickness regulating roller is a metal roller that rotates in contact with the cleaning roller.

10. The cleaning apparatus according to claim 9, wherein rotation directions of the metal roller and the cleaning roller are the same direction at the point of contact between the two rollers.

11. The cleaning apparatus according to claim 10, wherein a ratio (X) of the linear velocity of the metal roller relative to that of the cleaning roller is set such that $0<X\leqq 2$.

12. The cleaning apparatus according to claim 9, wherein an outer diameter of the metal roller is not an integral multiple of the outer diameter of the cleaning roller.

13. The cleaning apparatus according to claim 9, wherein an outer diameter of the metal roller is smaller than the outer diameter of the cleaning roller.

14. The cleaning apparatus according to claim 9, wherein processing to create an uneven surface is performed on the metal roller.

15. The cleaning apparatus according to claim 9, wherein a surface of the metal roller is covered by a synthetic resin.

16. The cleaning apparatus according to claim 9, wherein an outermost layer of the photosensitive drum is amorphous silicon.

17. An image forming apparatus comprising the cleaning apparatus according to claim 1.

18. An image forming apparatus comprising the cleaning apparatus according to claim 9.

19. A cleaning apparatus for a photosensitive drum, the cleaning apparatus comprising:

a cleaning roller that is positioned so as to be in contact with the photosensitive drum;

a toner layer thickness regulating member that regulates the thickness of a toner layer adhering to the surface of the cleaning roller; and the toner layer thickness regulating member comprising a toner layer thickness regulating roller that rotates in contact with the cleaning roller, wherein an outer diameter of the toner layer thickness regulating roller is not an integral multiple of the outer diameter of the cleaning roller.

20. A cleaning apparatus for a photosensitive drum, the cleaning apparatus comprising:

a cleaning roller that is positioned so as to be in contact with the photosensitive drum;

a toner layer thickness regulating member that regulates the thickness of a toner layer adhering to the surface of the cleaning roller; and the toner layer thickness regulating member comprising a toner layer thickness regulating roller that rotates in contact with the cleaning roller, wherein an outer diameter of the toner layer thickness regulating roller is smaller than the outer diameter of the cleaning roller.

21. A cleaning apparatus for a photosensitive drum, the cleaning apparatus comprising:

a cleaning roller that is positioned so as to be in contact with the photosensitive drum; and a toner layer thickness regulating member that regulates the thickness of a toner layer adhering to the surface of the cleaning roller; and the toner layer thickness regulating member comprises a metal roller that rotates in contact with the cleaning roller, wherein rotation directions of the metal roller and the cleaning roller are the same direction at the point of contact between the two rollers, and a ratio (X) of the linear velocity of the metal roller relative to that of the cleaning roller is set such that $0<X\leqq 2$.

22. A cleaning apparatus for a photosensitive drum, the cleaning apparatus comprising:

a cleaning roller that is positioned so as to be in contact with the photosensitive drum;

a toner layer thickness regulating member that regulates the thickness of a toner layer adhering to the surface of the cleaning roller;

the toner layer thickness regulating member comprising one of a foaming body roller or a brush roller that rotates in contact with the cleaning roller; and the cleaning roller comprising a foaming body roller different from the toner layer thickness regulating member, wherein an outermost layer of the photosensitive drum is amorphous silicon.

* * * * *